US011730659B1

(12) United States Patent
Kennedy

(10) Patent No.: US 11,730,659 B1
(45) Date of Patent: Aug. 22, 2023

(54) COUNTER-BALANCING GYROSCOPIC WALKER

(71) Applicant: Burton Lee Kennedy, Sugar Grove, NC (US)

(72) Inventor: Burton Lee Kennedy, Sugar Grove, NC (US)

( * ) Notice: Subject to any disclaimer, the term of this patent is extended or adjusted under 35 U.S.C. 154(b) by 275 days.

(21) Appl. No.: 17/202,437

(22) Filed: Mar. 16, 2021

(51) Int. Cl.
*A61H 3/04* (2006.01)

(52) U.S. Cl.
CPC ..... *A61H 3/04* (2013.01); *A61H 2003/043* (2013.01); *A61H 2201/01* (2013.01); *A61H 2201/1207* (2013.01)

(58) Field of Classification Search
None
See application file for complete search history.

(56) References Cited

U.S. PATENT DOCUMENTS 6,668,846 B2 12/2003 Meador
8,418,705 B2 * 4/2013 Ota ..... A61H 3/04 700/71
8,485,053 B2 * 7/2013 Lee ..... G01C 21/18 74/5.4
8,925,563 B2 * 1/2015 Ota ..... B60L 50/52 135/85
9,119,757 B2 9/2015 Triolo et al.
9,125,790 B2 9/2015 van Gerpen
9,314,387 B2 4/2016 AlSayed
9,468,272 B1 10/2016 Hyde
9,675,515 B2 6/2017 Chou
10,002,511 B2 6/2018 Condon
2013/0014790 A1 * 1/2013 Van Gerpen ..... A61H 3/04 362/102
2014/0109944 A1 * 4/2014 Triolo ..... A61H 3/00 135/67
2018/0356233 A1 12/2018 Baqain
2019/0142684 A1 * 5/2019 Liang ..... A61H 1/00 135/66
2021/0236022 A1 * 8/2021 Shugert ..... A61B 5/1128

FOREIGN PATENT DOCUMENTS

CA 2963072 5/2015

* cited by examiner

*Primary Examiner* — David R Dunn
*Assistant Examiner* — Danielle Jackson
(74) *Attorney, Agent, or Firm* — Kyle A. Fletcher, Esq.

(57) ABSTRACT

The counter-balancing gyroscopic walker is adapted for use with a patient. The counter-balancing gyroscopic walker is a mobility assistance device used by the patient. The counter-balancing gyroscopic walker forms a cart used by the patient for walking. The counter-balancing gyroscopic walker incorporates a housing structure, a plurality of inertial structures, and a control circuit. The plurality of inertial structures and the control circuit install in the housing structure. The housing structure is a physical supporting structure that that assists the mobility of the patient. The control circuit provides controls the operation of the plurality of inertial structures. The control circuit provides electrical energy required for the operation of the plurality of inertial structures. The plurality of inertial structures forms a gyroscopic system that tends to resists tilt of the counter-balancing gyroscopic walker from a set position relative to the force of gravity.

17 Claims, 7 Drawing Sheets

COUNTER-BALANCING GYROSCOPIC WALKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of physical therapy apparatus including mobility assistance appliances, more specifically, a walking aid stability apparatus. (A61H3/00)

SUMMARY OF INVENTION

The counter-balancing gyroscopic walker is adapted for use with a patient. The counter-balancing gyroscopic walker is a mobility assistance device used by the patient. The counter-balancing gyroscopic walker forms a cart used by the patient for walking. The counter-balancing gyroscopic walker comprises a housing structure, a plurality of inertial structures, and a control circuit. The plurality of inertial structures and the control circuit install in the housing structure. The housing structure is a physical supporting structure that assists the mobility of the patient. The control circuit provides controls the operation of the plurality of inertial structures. The control circuit provides electrical energy required for the operation of the plurality of inertial structures. The plurality of inertial structures forms a gyroscopic system that resists tilt of the counter-balancing gyroscopic walker from a set position relative to the force of gravity.

These together with additional objects, features and advantages of the counter-balancing gyroscopic walker will be readily apparent to those of ordinary skill in the art upon reading the following detailed description of the presently preferred, but nonetheless illustrative, embodiments when taken in conjunction with the accompanying drawings.

In this respect, before explaining the current embodiments of the counter-balancing gyroscopic walker in detail, it is to be understood that the counter-balancing gyroscopic walker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the counter-balancing gyroscopic walker.

It is therefore important that the claims be regarded as including such equivalent construction insofar as they do not depart from the spirit and scope of the counter-balancing gyroscopic walker. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
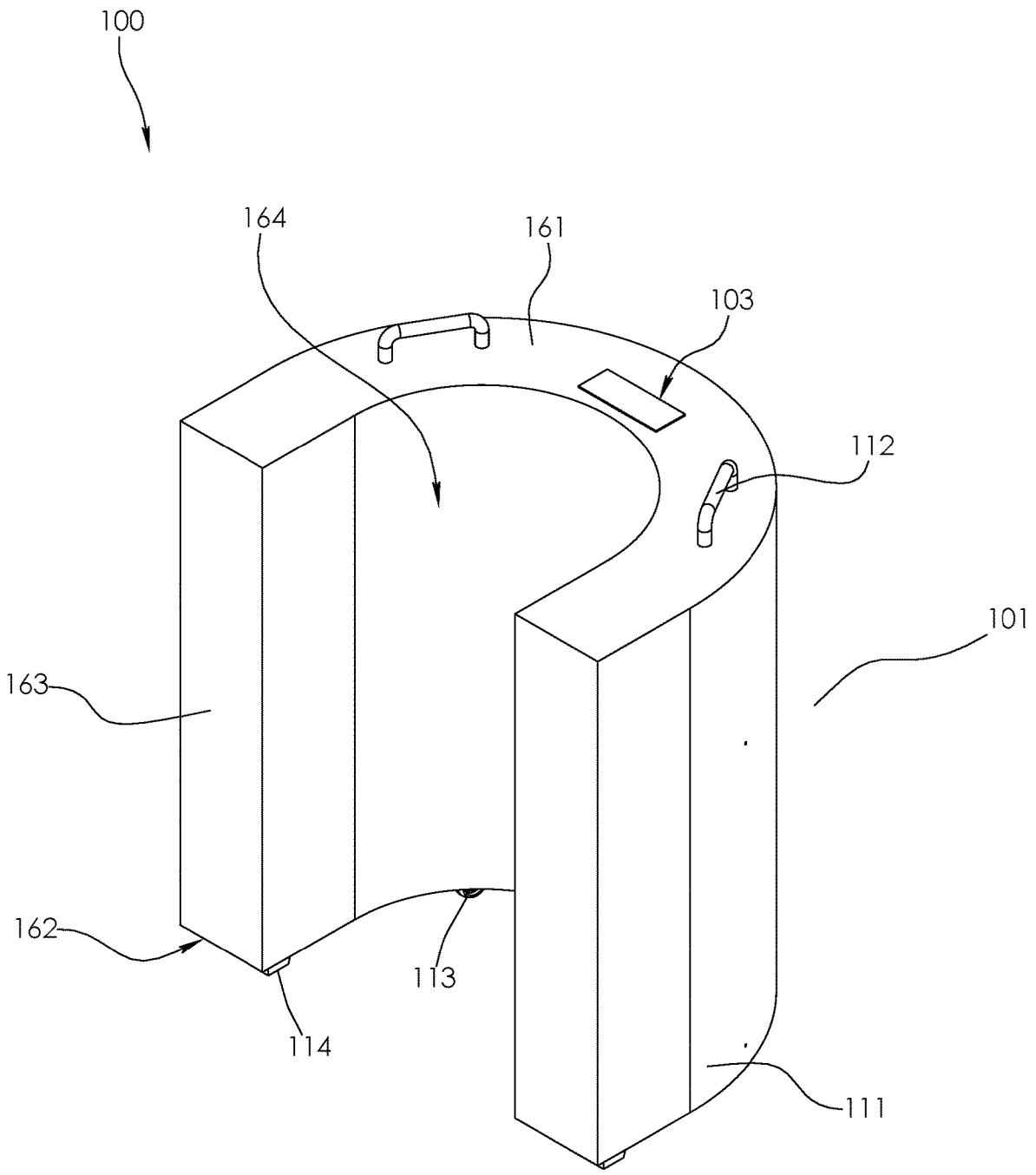
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

The counter-balancing gyroscopic walker 100 (hereinafter invention) is adapted for use with a patient 104. The invention 100 is a mobility assistance device used by the patient 104. The invention 100 forms a cart used by the patient 104 for walking. The invention 100 comprises a housing structure 101, a plurality of inertial structures 102, and a control circuit 103. The plurality of inertial structures 102 and the control circuit 103 install in the housing structure 101. The housing structure 101 is a physical supporting structure that that assists the mobility of the patient 104. The control circuit 103 provides controls the operation of the plurality of inertial structures 102. The control circuit 103 provides electrical energy required for the operation of the plurality of inertial structures 102. The plurality of inertial structures 102 forms a gyroscopic system that tends to resist tilt of the invention 100 from a set position relative to the force of gravity. The patient 104 is defined elsewhere in this disclosure.

The housing structure 101 is the physical structure of the housing structure 101 that provides mobility support to the patient 104. The housing structure 101 bears a portion of the load of the patient 104 as the patient 104 uses the invention 100. The housing structure 101 forms a cart that moves over a supporting surface 168.

The housing structure 101 is a hollow structure. The plurality of inertial structures 102 and the control circuit 103 mount in the hollow interior of the housing structure 101. The center axis of the prism structure of the housing structure 101 forms a vertical axis 165 that is parallel to the force of gravity when the invention 100 is used normally. The housing structure 101 is adapted for use by a patient 104. The housing structure 101 is a rolling structure. The housing structure 101 is a mobility assistance structure used by the patient 104.

The housing structure 101 forms a prism structure. The center axis of the housing structure 101 forms a vertical axis 165 that is parallel to the force of gravity when the invention 100 rests on a horizontal surface. The vertical axis 165 is the center axis of the prism structure formed by the framework 111. On a horizontal surface, the vertical axis 165 is parallel to the force of gravity. The primary sense of direction 166 refers to the primary sense of direction 166 of the cart formed by the housing structure 101. The primary sense of direction 166 is defined elsewhere in this disclosure. The housing structure 101 is further defined with a turning movement 269 and a horizontal axis 267. The turning movement 269 refers to the rotation of the primary sense of direction 166 of the housing structure 101 around an axis of rotation formed by the vertical axis 165. The horizontal axis 267 refers to the axis that is perpendicular to both the vertical axis 165 and the primary sense of direction 166 of the housing structure 101.

The housing structure 101 comprises a u-shaped structure 111, a handle structure 112, a plurality of casters 113, and a plurality of footings 114. The housing structure 101 further comprises the vertical axis 165 and the primary sense of direction 166.

The u-shaped structure 111 forms the exterior structure of the u-shaped structure 111. The u-shaped structure 111 is a prism-shaped structure. The u-shaped structure 111 is a hollow structure. The negative space formed by the arms and the crossbeam of the u-shaped structure 111 forms the protected space 164. The patient 104 stands within the protected space 164 when using the invention 100. The protected space 164 of the u-shaped structure 111 forms a protective shell around the patient 104 as the patient 104 is moving. The u-shaped structure 111 comprises a superior face 161, an inferior face 162, and a plurality of lateral faces 163. The u-shaped structure 111 forms a protected space 164. The handle structure 112, the plurality of casters 113, and the plurality of footings 114 mount on the u-shaped structure 111.

The superior face 161 is a congruent end of the prism structure of the u-shaped structure 111. The superior face 161 forms the superior surface of the u-shaped structure 111. The superior face 161 has a u-shape.

The inferior face 162 is a congruent end of the prism structure of the u-shaped structure 111. The inferior face 162 forms the superior surface of the u-shaped structure 111. The inferior face 162 has a u-shape. The inferior face 162 is the congruent end of the u-shaped structure 111 that is proximal to the supporting surface 168. The inferior face 162 is the congruent end of the u-shaped structure 111 that is distal from the superior face 161.

The plurality of lateral faces 163 form the lateral face of the prism structure of the u-shaped structure 111. The plurality of lateral faces 163 form the vertically oriented containment surfaces of the u-shaped structure 111.

The protected space 164 is defined elsewhere in this disclosure.

The handle structure 112 comprises one or more grips that are mounted on the exterior surface of the u-shaped structure 111. The handle structure 112 forms a structure that the patient 104 can grasp for stability.

Each of the plurality of casters 113 is a rolling structure.

Each of the plurality of casters 113 mounts on the inferior face 162 of the housing structure 101. Each of the plurality of casters 113 transfers a portion of the load of the invention 100.

Each of the plurality of footings 114 is a pedestal structure that attaches to the inferior face 162 of the housing structure 101. Each of the plurality of footings 114 transfers a portion of the load of the invention 100 to a supporting surface 168 when the invention 100 is not being rolled along the supporting surface 168. Each of the plurality of footings 114 fixes the invention 100 in a stationary position when the invention 100 is not in use.

Each of the plurality of inertial structures 102 is an electromechanical device. Each of the plurality of inertial structures 102 is an electrically powered device. Each of the plurality of inertial structures 102 generates a rotation that stores an angular momentum. The angular momentum stored by each of the plurality of inertial structures 102 is used to produce gyroscopic torque. Gyroscopic torque resists any tilt 167 of the housing structure 101 caused by transient or periodic forces acting on the housing structure 101. By the resisting the tilt 167 of the housing structure 101 is meant that each of the plurality of inertial structures 102 will generate a counterforce in a direction that aligns the vertical axis 165 of the housing structure 101 with the direction of the force of gravity.

The plurality of inertial structures 102 comprises a first inertial structure 121 and a second inertial structure 131. Each of the plurality of inertial structures 102 will produce gyroscopic torque maximally in one direction. Ideally, the plurality of inertial structures 102 are oriented such that the vertical axis 165 of the invention 100, or any other selected axis of the invention 100, is stabilized in a plurality of directions. The production of gyroscopic torque requires both angular momentum and precession movement. Without precession movement, no gyroscopic torque is produced.

The first inertial structure 121 is an electromechanical device. The first inertial structure 121 is a rotating structure. The rotation of the first inertial structure 121 generates and stores an angular momentum in a first axis of rotation 241. The first axis of rotation 241, itself, moves in a first precession movement 120. The first precession movement 120 is, ideally, rotation around the vertical axis 165 or other selected axis. The combination of the stored angular momentum and the first precession movement 120 produces a gyroscopic torque that stabilizes the housing structure 101 in a first direction. By stabilizing the housing structure 101 is meant that the gyroscopic torque of the first inertial structure 121 will generate a counterforce in a direction that aligns the vertical axis 165 of the housing structure 101 with the direction of the force of gravity when the housing structure 101 experiences a displacing force.

The first inertial structure 121 comprises a first flywheel 125, a first electric motor 124, and a first guide rail system 126.

The first guide rail system 126 is a means of conveyance for the first precession movement 120. The first guide rail system 126 comprises a first plurality of carriages 127, a first plurality of guide rails 128, a first plurality of slider bearings 129, and a first plurality of springs 122. The first slider bearings 129 are attached to the first carriage 127. The first guide rail 128 is attached to one or more interior surfaces of the plurality of lateral faces 163 of the u-shaped structure 111. The first carriage 127 moves along the first guide rail 128 in the first precession movement 120.

The first plurality of springs 122 attach the first carriage 127 to one or more interior surfaces of the plurality of lateral faces 163 of the u-shaped structure 111. The use of the first plurality of springs 122 acts to slowly return the first carriage 127 to its starting point on the first guide rail 128 after the first carriage 127 has completed the first precession movement 120.

The first electric motor 124 attaches to the first carriage 127. The first electric motor 124 is an electric motor. The electric motor is defined elsewhere in this disclosure. The first electric motor 124 converts electrical energy into angular momentum in the form of a rotation. The control circuit 103 controls the operation of the first electric motor 124. The first electric motor 124 provides a portion of motive forces necessary to generate the angular momentum used to stabilize the housing structure 101.

The first flywheel 125 is a disk-shaped structure. The first flywheel 125 is a rotating structure that contains the angular momentum stored by the first inertial structure 121. The flywheel is defined elsewhere in this disclosure. The first flywheel 125 attaches to the first electric motor 124 such that the center axis of the disk structure of the first flywheel 125 aligns with the axis of rotation of the first electric motor 124. The first electric motor 124 provides the motive forces used to: a) initiate the rotation of the first flywheel 125; and, b) maintain the rotational speed of the first flywheel 125.

The second inertial structure 131 is an electromechanical device. The second inertial structure 131 is a rotating structure. The rotation of the second inertial structure 131 generates and stores an angular momentum in a second axis of rotation 242. The second axis of rotation 242, itself, moves in a second precession movement 130. The second precession movement 130 is, ideally, rotation around the vertical axis 165 or other selected axis. The combination of the stored angular momentum and the second precession movement 130 produces a gyroscopic torque that stabilizes the housing structure 101 in a second direction. By stabilizing the housing structure 101 is meant that the gyroscopic torque of the second inertial structure 131 will generate a counterforce in a direction that aligns the vertical axis 165 of the housing structure 101 with the direction of the force of gravity when the housing structure 101 experiences a displacing force. The first inertial structure 121 and the second inertial structure 131 are oriented to stabilize the invention 100 in more than one direction.

The second inertial structure 131 comprises a second flywheel 135, a second electric motor 134, and a second guide rail system 136.

The second guide rail system 136 is a means of conveyance for the second precession movement 130. The second guide rail system 136 comprises a second plurality of carriages 137, a second plurality of guide rails 138, a second plurality of slider bearings 139, and a second plurality of springs 132. The second slider bearings 139 are attached to the second carriage 137. The second guide rail 138 is attached to one or more interior surfaces of the plurality of lateral faces 163 of the u-shaped structure 111. The second carriage 137 moves along the second guide rail 138 in the second precession movement 130.

The second plurality of springs 132 attach the second carriage 137 to one or more interior surfaces of the plurality of lateral faces 163 of the u-shaped structure 111. The use of the second plurality of springs 132 acts to slowly return the second carriage 137 to its starting point on the second guide rail 138 after the second carriage 137 has completed the second precession movement 130.

The second electric motor 134 attaches to the second carriage 137. The second electric motor 134 is an electric motor. The electric motor is defined elsewhere in this disclosure. The second electric motor 134 converts electrical energy into angular momentum in the form of a rotation. The control circuit 103 controls the operation of the second electric motor 134. The second electric motor 134 provides a portion of motive forces necessary to generate the angular momentum used to stabilize the housing structure 101.

The second flywheel 135 is a disk-shaped structure. The second flywheel 135 is a rotating structure that contains the angular momentum stored by the second inertial structure 131. The flywheel is defined elsewhere in this disclosure. The second flywheel 135 attaches to the second electric motor 134 such that the center axis of the disk structure of the second flywheel 135 aligns with the axis of rotation of the second electric motor 134. The second electric motor 134 provides the motive forces used to: a) initiate the rotation of the second flywheel 135; and, b) maintain the rotational speed of the second flywheel 135.

The control circuit 103 is an electric circuit. The control circuit 103 controls the operation of the plurality of inertial structures 102. The control circuit 103 provides the electric energy required to operate the plurality of inertial structures 102. The control circuit 103 controls the amount of angular momentum contained in each of the plurality of inertial structures 102 by controlling the speed of rotation of each of the plurality of inertial structures 102. The control circuit 103 comprises a first motor controller 141, a second motor controller 142, a speed control sub-circuit 143, and a power circuit 144. The first motor controller 141, the second motor controller 142, the speed control sub-circuit 143, and the power circuit 144 are electrically interconnected. The control circuit 103 is an independently powered electric circuit. By independently powered is meant that the control circuit 103 can operate without an electrical connection to an external power source 184.

The first motor controller 141 is an electric circuit that controls the speed of rotation and the direction of rotation of the first electric motor 124. The motor controller is defined elsewhere in this disclosure. The first motor controller 141 monitors a voltage generated by the speed control sub-circuit 143 to determine the speed of rotation of the first electric motor 124.

The second motor controller 142 is an electric circuit that controls the speed of rotation and the direction of rotation of the second electric motor 134. The motor controller is defined elsewhere in this disclosure. The second motor controller 142 monitors a voltage generated by the speed control sub-circuit 143 to determine the speed of rotation of the second electric motor 134.

The second motor controller 142 sets the direction of rotation of the second electric motor 134 to the opposite direction of the first electric motor 124. The second motor controller 142 monitors the same voltage as is monitored by the first motor controller 141.

The speed control sub-circuit 143 is an electric circuit. The speed control sub-circuit 143 generates the voltage used by the first motor controller 141 and the second motor controller 142 to determine the speed of rotation of the first electric motor 124 and the second electric motor 134. The speed control sub-circuit 143 is a voltage divider circuit that allows for the adjustment of the voltage presented to the first motor controller 141 and the second motor controller 142. The speed control sub-circuit 143 comprises a load resistor 171 and a potentiometer 172. The load resistor 171 forms a series electric connection with the potentiometer 172.

The load resistor 171 is an electrical resistor. The electrical resistor is defined elsewhere in this disclosure. The resistance presented by the load resistor 171 is fixed. The load resistor 171 electrically connects to the potentiometer 172 to form a voltage divider. The voltage divider is defined elsewhere in this disclosure. The potentiometer 172 is an electrical device that presents a variable resistance to an electric circuit. The potentiometer 172 is defined elsewhere in this disclosure. The voltage across the potentiometer 172 presents the voltage used by the first motor controller 141 to control the speed of rotation of the first electric motor 124. The potentiometer 172 presents the voltage used by the second motor controller 142 to control the speed of rotation of the second electric motor 134. The voltage presented to the first motor controller 141 and the second motor controller 142 is adjusted by adjusting the resistance presented by the potentiometer 172 to the voltage divider circuit.

The power circuit 144 is an electrical circuit. The power circuit 144 powers the operation of the control circuit 103. The power circuit 144 is an electrochemical device. The power circuit 144 converts chemical potential energy into the electrical energy required to power the control circuit 103. The power circuit 144 comprises a battery 181, a diode 182, a charging port 183, an external power source 184, and a master switch 186. The external power source 184 further comprises a charging plug 185. The battery 181, the diode 182, the charging port 183, the external power source 184, the charging plug 185, and the master switch 186 are electrically interconnected. The battery 181 further comprises a first positive terminal 191 and a first negative terminal 193. The external power source 184 further comprises a second positive terminal 192 and a second negative terminal 194.

The battery 181 is an electrochemical device. The battery 181 converts chemical potential energy into the electrical energy used to power the control circuit 103. The battery 181 is a commercially available rechargeable battery 181. The chemical energy stored within the rechargeable battery 181 is renewed and restored through the use of the charging port 183. The charging port 183 is an electrical circuit that reverses the polarity of the rechargeable battery 181 and provides the energy necessary to reverse the chemical processes that the rechargeable battery 181 initially used to generate the electrical energy. This reversal of the chemical process creates a chemical potential energy that will later be used by the rechargeable battery 181 to generate electricity.

The charging port 183 forms an electrical connection to an external power source 184 using a charging plug 185. The charging plug 185 forms a detachable electrical connection with the charging port 183. The charging port 183 receives electrical energy from the external power source 184 through the charging plug 185. The diode 182 is an electrical device that allows current to flow in only one direction. The diode 182 installs between the rechargeable battery 181 and the charging port 183 such that electricity will not flow from the first positive terminal 191 of the rechargeable battery 181 into the second positive terminal 192 of the external power source 184.

The following definitions were used in this disclosure:

Aft: As used in this disclosure, aft is a term that relates a first object to a second object. When the second object is closer to the stern of a vehicle, the second object is said to be aft of the first object. The term is commonly used on vessels and vehicles.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Angular Momentum: As used in this disclosure, the angular momentum is a measured quantity that is associated with a rotating object. The angular momentum is a function of: a) the moment of inertia of the object; b) and the rotational speed of the object. The exchange of angular momentum between two objects is a conserved quantity meaning that the sum of the angular momentums of the two objects before an exchange of angular momentum equals the sum of the angular momentums of the two objects after the exchange.

Anterior: As used in this disclosure, anterior is a term that is used to refer to the front side or direction of a structure. When comparing two objects, the anterior object is the object that is closer to the front of the structure. The anterior is the structure of an object that leads the object into the primary sense of direction of the object.

Battery: As used in this disclosure, a battery is a chemical device consisting of one or more cells, in which chemical energy is converted into electricity and used as a source of power. Batteries are commonly defined with a positive terminal and a negative terminal.

Bow: As used in this disclosure, the bow refers to the anterior side of an object, vehicle, or vessel. Specifically, the bow refers to the most forward element of the object in the direction of the primary sense of direction of the object vehicle, or vessel.

Brace: As used in this disclosure, a brace is a structural element that is used to support, stabilize, or otherwise steady an object.

Cant: As used in this disclosure, a cant is an angular deviation from one or more reference lines (or planes) such as a vertical line (or plane) or a horizontal line (or plane).

Cart: As used in this disclosure, a cart is small vehicle intended to be moved by a person. A synonym for cart is hand cart.

Caster: As used in this disclosure, a caster is a wheel that is mounted on a swivel that allows the wheel to adjust, or swivel, the direction of rotation of the wheel to the direction of motion desired for the wheel. The generic parts of a caster are called the stem, the swivel bearing, the swivel mount, and the wheel. The swivel bearing attaches the stem to the swivel mount such that the swivel mount will rotate relative to the stem. The wheel attaches to the swivel mount such that the wheel freely rotates relative to the swivel mount. The direction of the axis of rotation of the wheel is perpendicular to the direction of the axis of rotation of the swivel mount. The stem attaches the swivel bearing, the swivel mount, and the wheel to an externally provided object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

External Power Source: As used in this disclosure, an external power source is a source of the energy that is externally provided to enable the operation of the present disclosure. Examples of external power sources include, but are not limited to, electrical power sources and compressed air sources.

Flywheel: As used in this disclosure, a flywheel is a rotating disk structure that is used to store angular momentum (or rotational energy). The flywheel is commonly used to dampen the effect that a transient force or a periodic force can have on a system. A flywheel is often formed with a non-uniform density structure such that the density of the structure of the flywheel increases as the span of the distance between the center axis of the flywheel and any second point of the flywheel increases. This non-uniform density distribution increases the amount of angular momentum stored by the flywheel for a fixed mass of the flywheel.

Footing: As used in this disclosure, a footing refers to one of a plurality of small pedestals that combine to: a) raise an object above a supporting surface; and, b) transfer the load path of the object to the supporting surface.

Force: As used in this disclosure, a force refers to a net (or unopposed) measurable interaction that changes the direction of motion of an object, the velocity of motion of an object, the momentum of an object, or the stress within an object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Forward: As used in this disclosure, forward is a term that relates a first object to a second object. When the first object is closer to the bow of a vehicle, the first object is said to be forward of the second object. The term is commonly used on vessels and vehicles.

Frame: As used in this disclosure, a frame is a structure or a first sub-structure: a) to which an object or a second sub-structure attaches; and, b) which forms a portion of the load path of the object or the second sub-structure.

Framework: As used in this disclosure, a framework refers to the substructure of an object that forms the load path of the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Gimbal: As used in this disclosure, a gimbal is a pivoting structure that supports an object in such a manner that the object can be rotated around a single axis of rotation. An object mounted in a first gimbal can be mounted in a second gimbal such that: 1) the first gimbal can be rotated within the second gimbal; and, 2) the object subsequently has a second axis of rotation. Such methods can be repeated in a recursive manner. Designs and methods to mount gimbals in gimbals are well-known and documented in the mechanical arts. Gimbals are often used to keep an object steady in a moving environment.

Grip: As used in this disclosure, a grip is an accommodation formed on or within an object that allows the object to be grasped or manipulated by a hand.

Gyroscope: As used in this disclosure, a gyroscope is a rotating body. The angular momentum of a gyroscope is such that when a force is applied to a gyroscope that deflects the axis of rotation of the gyroscope, the gyroscope will generate an opposing force that attempts to return the center axis of the gyroscope to the line of its original axis of rotation. The gyroscope is often mounted in a gimbal such that the center of rotation will remain in a fixed position that is independent of the movement and rotation of the structure that the combined structure of the gyroscope and gimbal is mounted in.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inertia: As used in this disclosure, the term inertia describes an object that is not under the influence of an accelerating force. By under the influence is meant that the velocity of the object maintains a constant speed and direction (i.e. the object is not under acceleration or deceleration).

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Load Resistor: As used in this disclosure, a load resistor is an electrical resistor that is used to present a voltage to an electrical device. The presented voltage is controlled by controlling the amount of electrical current passing through the load resistor.

Maintained Switch: A used in this disclosure, a maintained switch is a switch that maintains the position that was set in the most recent switch actuation. A maintained switch works in an opposite manner to a momentary switch.

Mobility Assistance Device: As used in this disclosure, a mobility assistance device is a mechanical device used to help patients with limited mobility to move.

Moment of Inertia: As used in this disclosure, the moment of inertia of an object is a function of its shape and mass distribution. The moment of inertia of an object is a measure of the resistance of the object to angular acceleration about a given axis. The moment of inertia is calculated as the sum of: a) the mass of each element of the object; multiplied by, b) the square of the distance of element's distance from the given axis.

Momentum: As used in this disclosure, momentum is a measured quantity associated with the mass of a moving object. The momentum of the object equals the mass of the object multiplied by the velocity of the object. The exchange of momentum between two objects is a conserved quantity meaning that the sum of the momentums of the two objects before an exchange of momentum equals the sum of the momentums of the two objects after the exchange.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with one or more openings that allow for visibility and fluid flow through the structure. Wrought work and meshes are forms of openwork.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of the prism structure of the pan and/or a portion of the closed lateral faces of the pan is are open.

Patient: As used in this disclosure, a patient is a person who is designated to receive a medical treatment, therapy or service. The term patient may be extended to an animal when used within the context of the animal receiving veterinary treatment or services.

Pedestal: As used in this disclosure, a pedestal is an intermediary load bearing structure that that forms a load path between a supporting surface and an object, structure, or load.

Perimeter: As used in this disclosure, a perimeter is one or more curved or straight lines that bounds an enclosed area on a plane or surface. The perimeter of a circle is commonly referred to as a circumference.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Port: As used in this disclosure, port refers to the left side of a vehicle when a viewer is facing towards the primary sense of direction of the vehicle.

Posterior: As used in this disclosure, posterior is a term that is used to refer to the side of an object that is distal or in the opposite direction of the anterior side. When comparing two items, the posterior item is the item that is distal from the anterior of the object.

Potentiometer: As used in this disclosure, a potentiometer is an adjustable electrical device that presents a resistance to an electric. The level of resistance is adjustable.

Precession Movement: As used in this disclosure, precession movement is the natural gyroscopic tendency of a rotating body to move in a direction that is perpendicular to the direction of an applied force.

Primary Sense of Direction: As used in this disclosure, the primary sense of direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; or, b) maintains an environment suitable within the protected space that is appropriate for the object.

Pull-Down Resistor: As used in this disclosure, a pull-down resistor is an electrical resistor that is used within an electrical circuit as a load resistor or a limit resistor.

Pull-Up Resistor: As used in this disclosure, a pull-up resistor is an electrical resistor that is used to: 1) limit the current flow through a switching device; and, 2) to control the voltage level presented across a switch, a load resistor, or a pull-down resistor.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Roughly: As used in this disclosure, roughly refers to a comparison between two objects. Roughly means that the difference between one or more parameters of the two compared objects are not significantly different.

Starboard: As used in this disclosure, starboard refers to the right side of a vehicle when a viewer is facing towards the primary sense of direction of the vehicle.

Stern: As used in this disclosure, the stern refers to the posterior side of an object, vehicle, or vessel. The stern is distal from the bow along the primary sense of direction.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Swivel: As used in this disclosure, a swivel is a fastening structure that attaches a first object to a second object such that will rotate around an axis of rotation while the second object remains in a fixed position relative to the first object.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever. An illiterate U-shaped structure is a U-shaped structure where the span of the length of the first arm does not equal the span of the length of the second arm.

Vehicle: As used in this disclosure, a vehicle is a device that is used for transporting passengers, goods, or equipment. The term motorized vehicle refers to a vehicle can move under power provided by an electric motor or an internal combustion engine.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Volt: As used in this disclosure, a volt refers to the difference in electrical potential energy between two points in an electric circuit. A volt is measured as joules per coulomb. The term voltage refers to a quantitative measure of the volts between the two points.

Voltage Divider: As used in this disclosure, a voltage divider is an electric circuit that comprises a plurality of resistors electrically connected in series. The voltage divider divides a voltage presented across the plurality of resistors into one or more smaller voltages that can be used elsewhere in an electric circuit. The value of the one or more smaller voltages presented by the voltage divider is controlled through the selection of the value of each of the plurality of resistors.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

Figure 2:
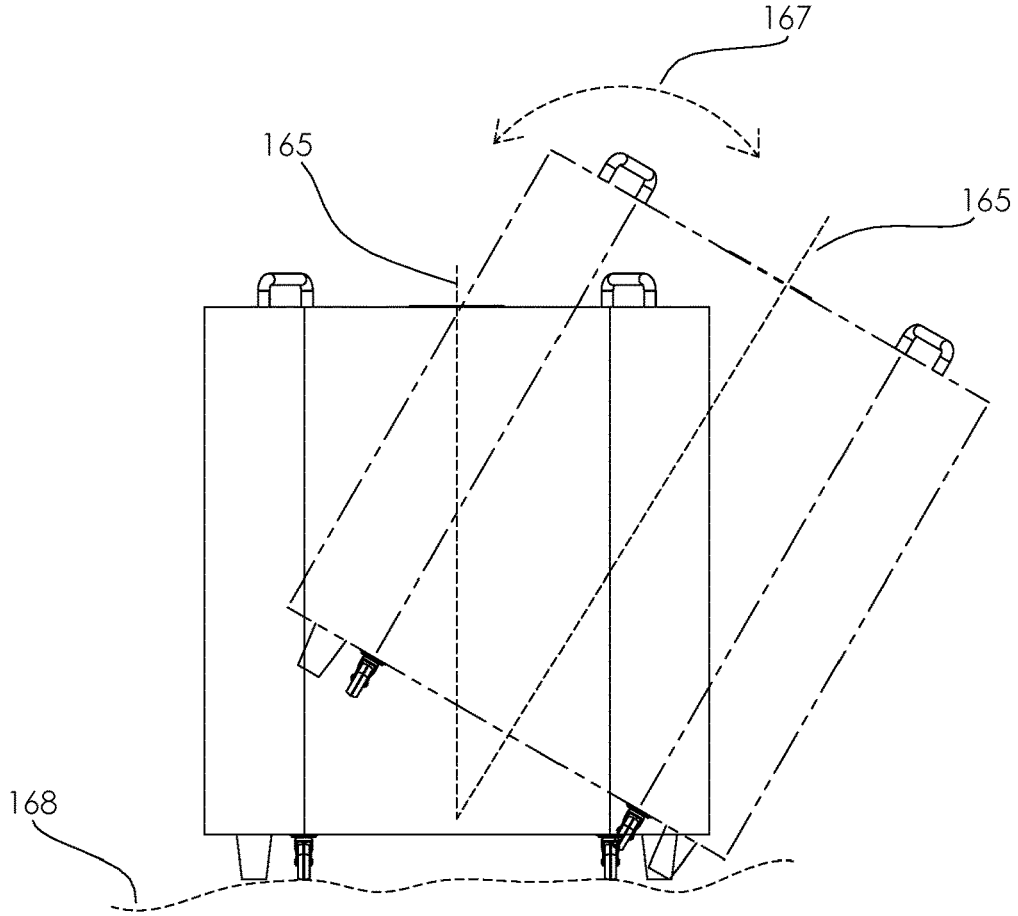
FIG. 2 is a front view of an embodiment of the disclosure.
Figure 3:
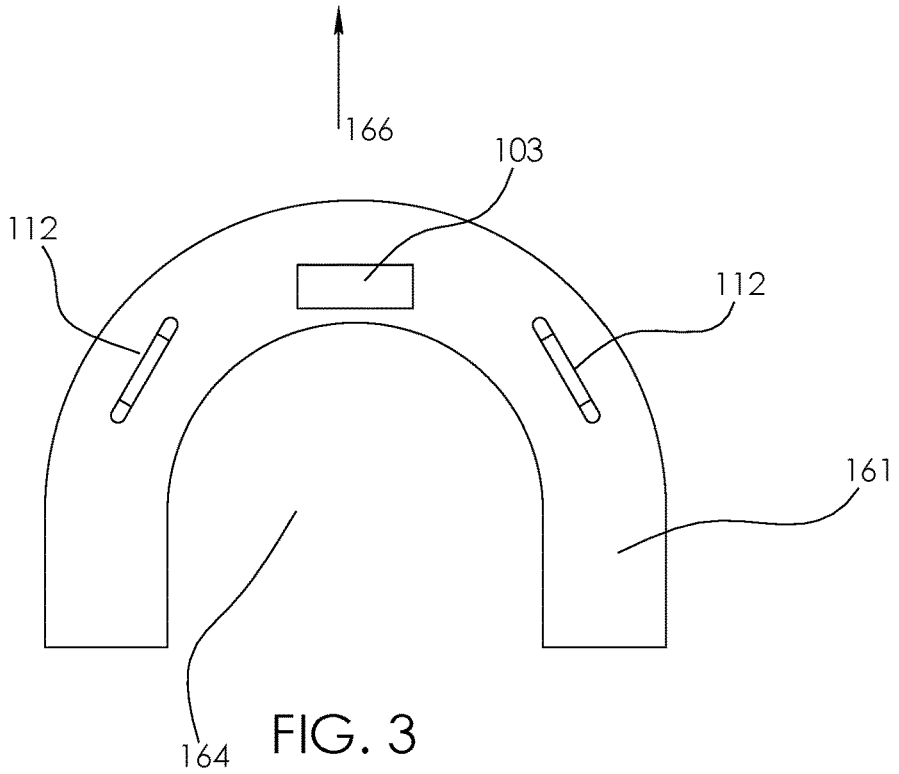
FIG. 3 is a top view of an embodiment of the disclosure.
Figure 4:
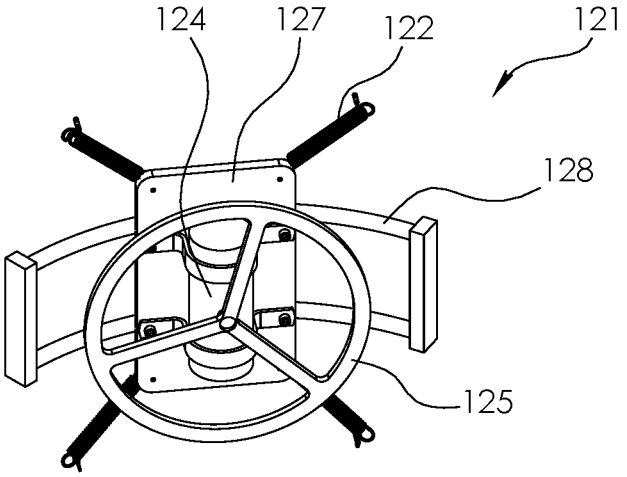
FIG. 4 is a detail view of an embodiment of the disclosure.
Figure 5:
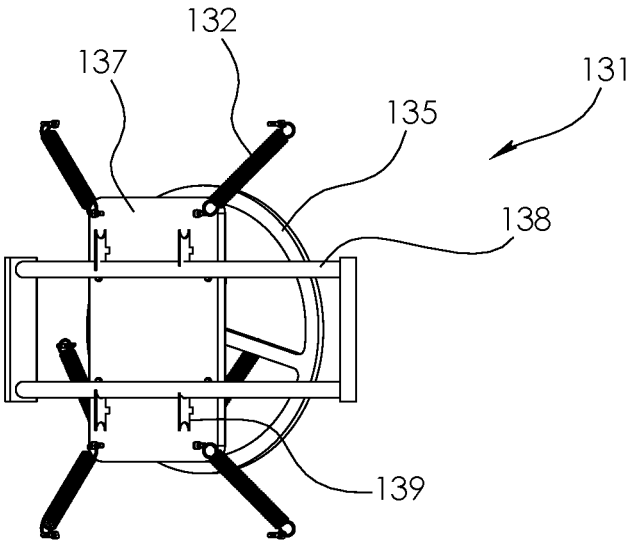
FIG. 5 is a detail view of an embodiment of the disclosure.
Figure 6:
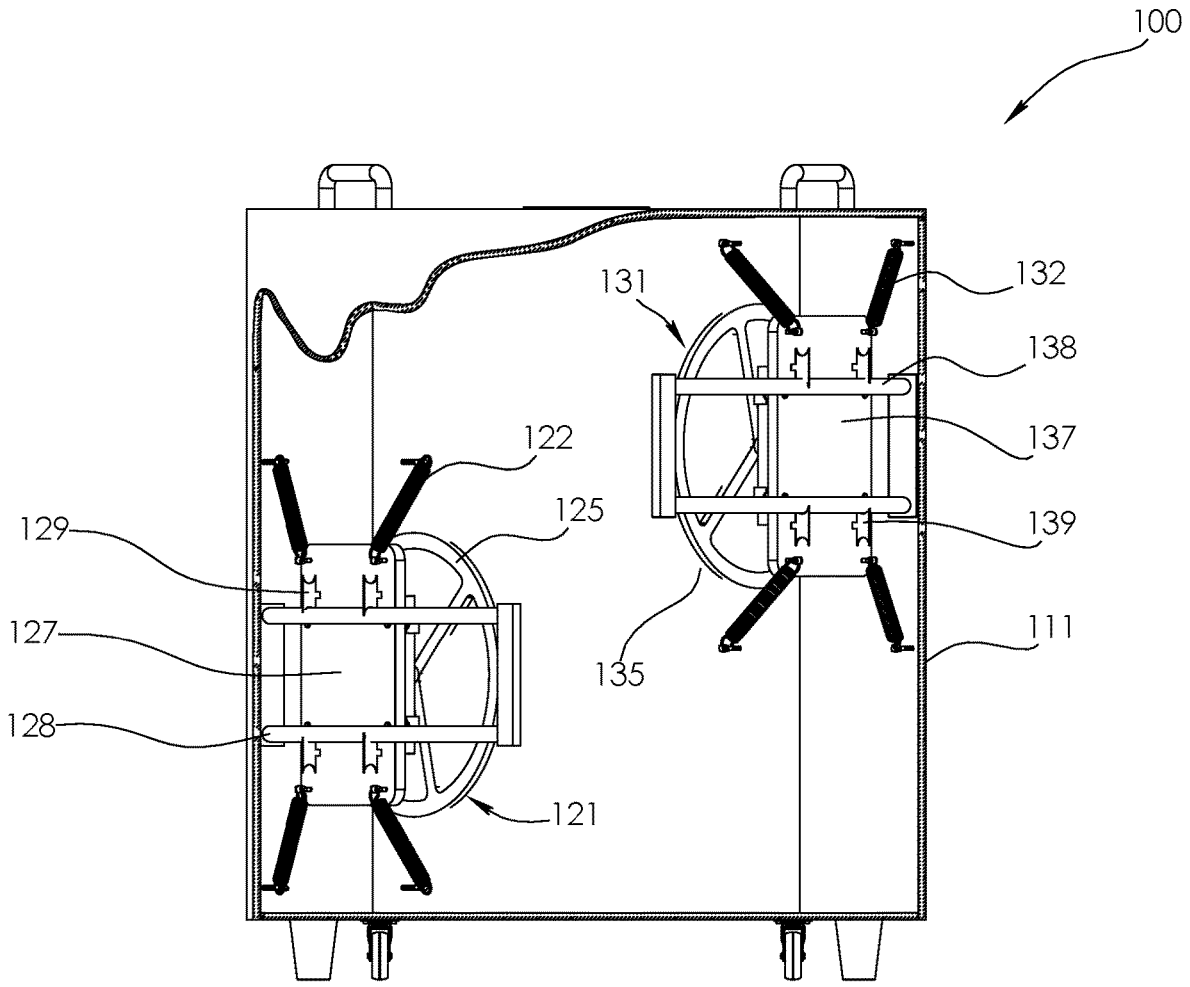
FIG. 6 is a cross-sectional view of an embodiment of the disclosure.
Figure 7:
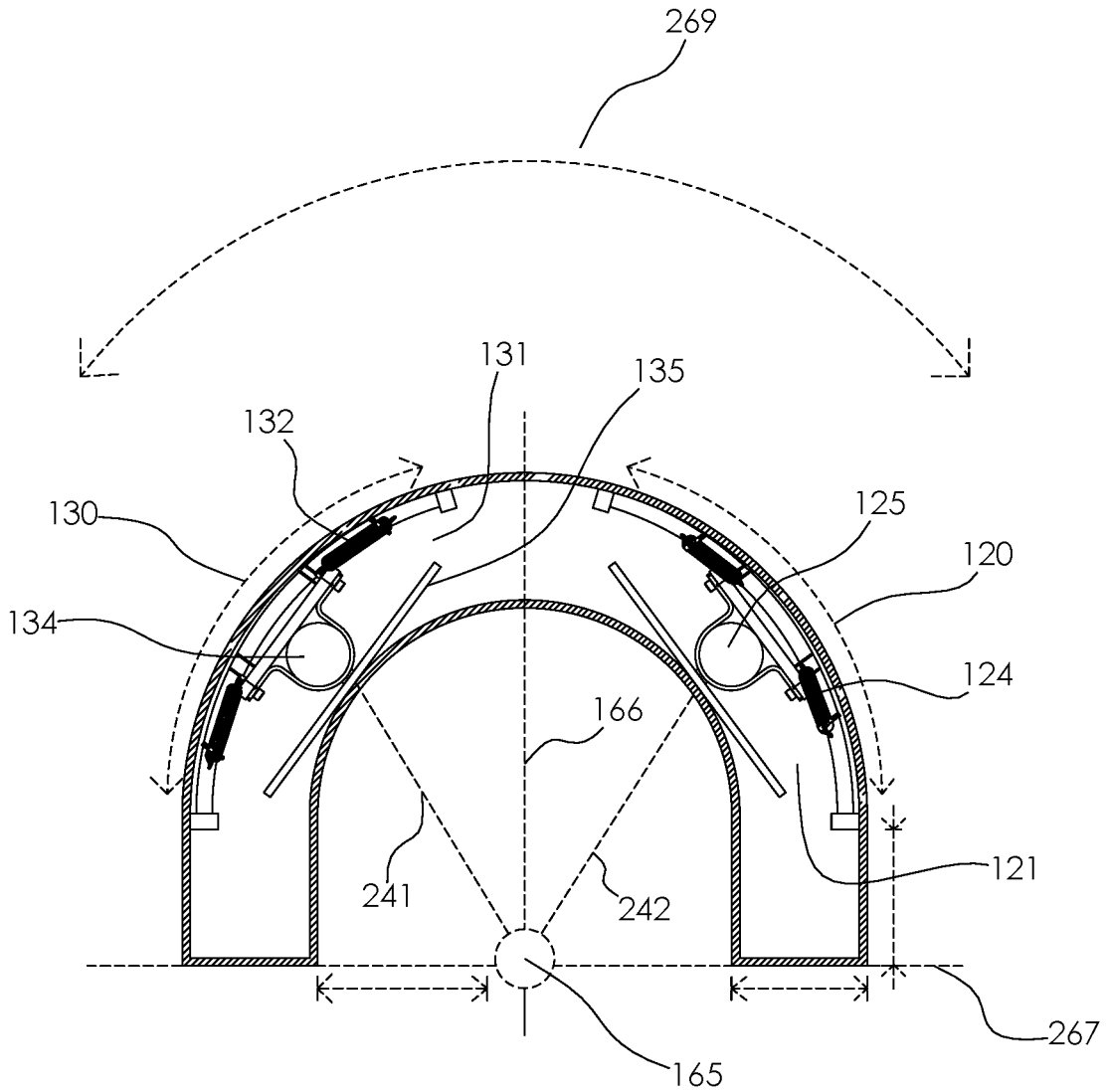
FIG. 7 is a cross-sectional view of an embodiment of the disclosure.
Figure 8:
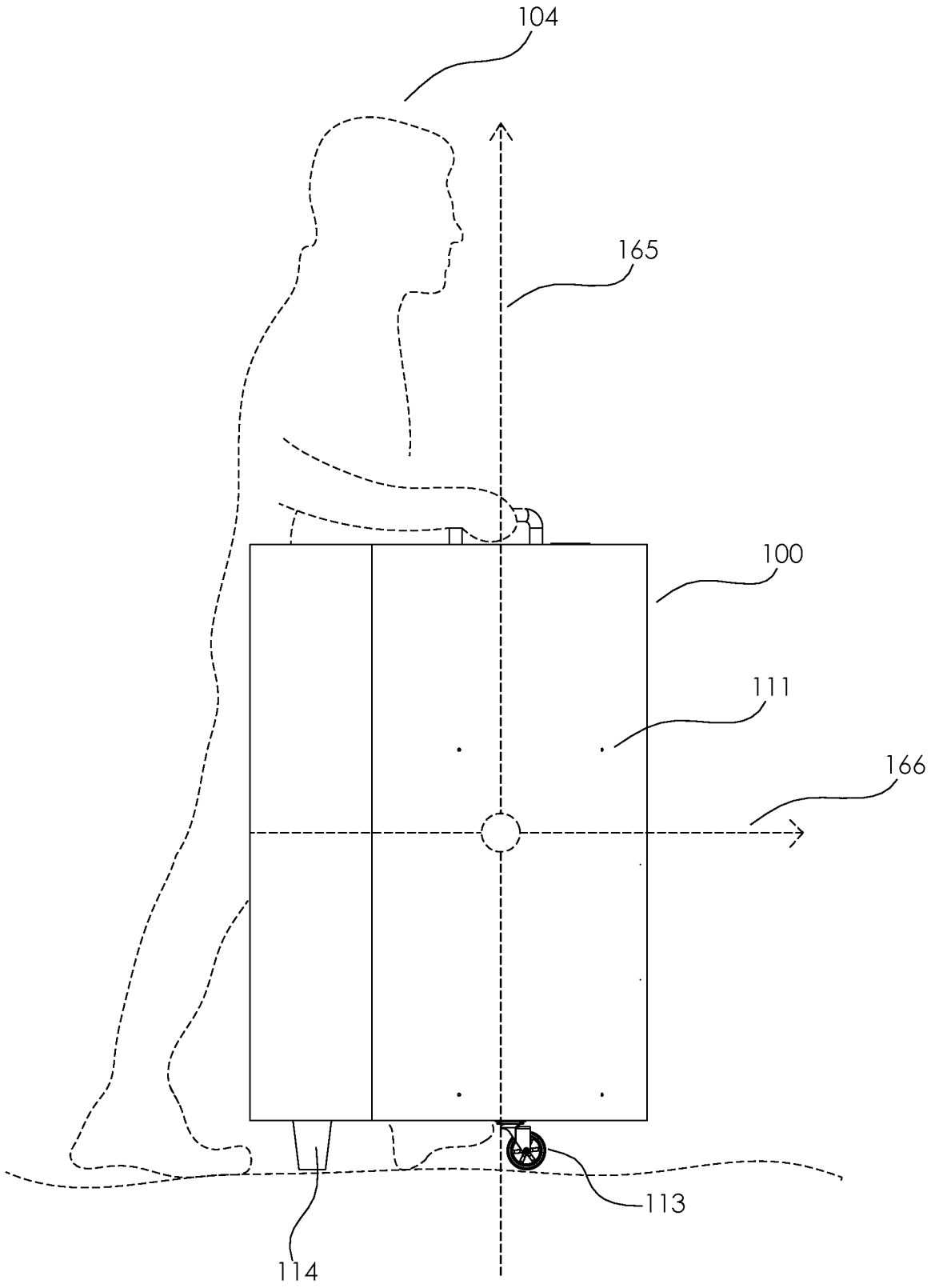
FIG. 8 is an in-use view of an embodiment of the disclosure.
Figure 9:
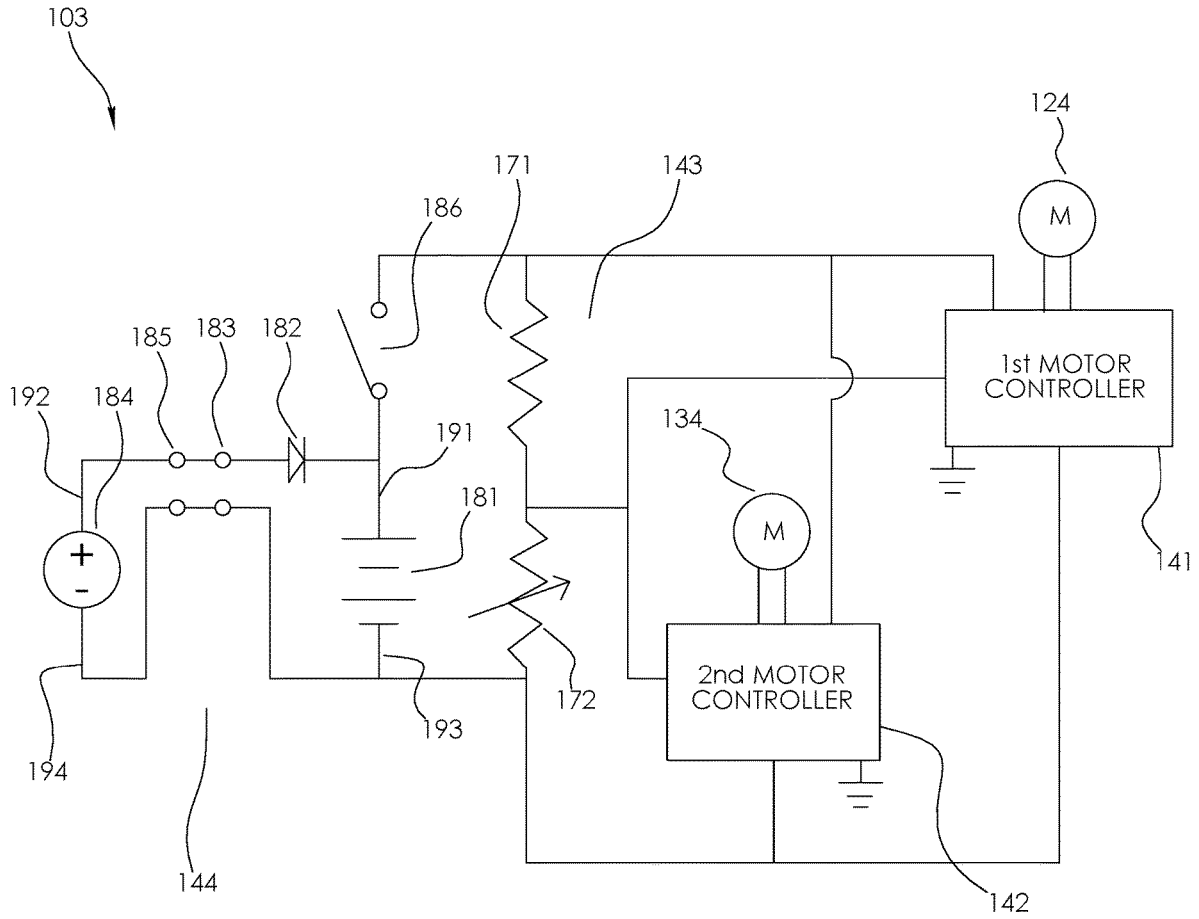
FIG. 9 is a schematic view of an embodiment of the disclosure.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A counter-balancing gyroscopic walker comprising
- a housing structure, at least one inertial structure, and a control circuit;
- wherein the at least one inertial structure and the control circuit are installed in the housing structure;
- wherein the at least one inertial structure forms a gyroscopic system that tends to resists tilt of the counter-balancing gyroscopic walker from a set position relative to the force of gravity;
- wherein the at least one inertial structure is a plurality of inertial structures;
- wherein the counter-balancing gyroscopic walker is a mobility assistance device that is adapted for use with a patient;
- wherein the housing structure forms a cart that moves over a supporting surface, and which is adapted to bear a portion of the load of the patient as the patient uses the counter-balancing gyroscopic walker;
- wherein a center axis of the housing structure forms a vertical axis that is parallel to the force of gravity when the counter-balancing gyroscopic walker rests on a horizontal surface.

2. The counter-balancing gyroscopic walker according to claim 1,
- wherein the control circuit is responsible for controlling the operation of the plurality of inertial structures;
- wherein the control circuit provides electrical energy required for the operation of the plurality of inertial structures.

3. The counter-balancing gyroscopic walker according to claim 2
- wherein each of the plurality of inertial structures is an electromechanical device;
- wherein each of the plurality of inertial structures generates a rotation that stores an angular momentum;
- wherein an axis of rotation of the angular momentum generated by each of the plurality of inertial structures stabilizes the vertical axis of the housing structure;
- wherein the angular momentum stored by each of the plurality of inertial structures resists any tilt relative to the vertical axis of the housing structure caused by transient or periodic forces acting on the housing structure;
- wherein each of the plurality of inertial structures will generate a counterforce in a direction that aligns the vertical axis of the housing structure with the direction of the force of gravity.

4. The counter-balancing gyroscopic walker according to claim 3
- wherein the control circuit controls the amount of angular momentum contained in each of the plurality of inertial structures by controlling the speed of rotation of each of the plurality of inertial structures;
- wherein the control circuit is an independently powered electric circuit;
- wherein by independently powered is meant that the control circuit can operate without an electrical connection to an external power source.

5. The counter-balancing gyroscopic walker according to claim 4 wherein the housing structure comprises a u-shaped housing, a handle structure, a plurality of casters, and a plurality of footings;

wherein the handle structure, the plurality of casters, and the plurality of footings attach to the u-shaped housing.

6. The counter-balancing gyroscopic walker according to claim 5 wherein the plurality of inertial structures comprises a first inertial structure and a second inertial structure;

wherein the first inertial structure is a rotating structure;

wherein the first inertial structure moves in a first precession movement;

wherein the stored angular momentum combined with the first precession movement is used to stabilize the housing structure;

wherein the second inertial structure is a rotating structure;

wherein the second inertial structure moves in a second precession movement;

wherein the stored angular momentum combined with the second precession movement is used to stabilize the housing structure.

7. The counter-balancing gyroscopic walker according to claim 6 wherein the first inertial structure and the second inertial structure are oriented to stabilize the counter-balancing gyroscopic walker in more than one direction.

8. The counter-balancing gyroscopic walker according to claim 7 wherein the control circuit comprises a first motor controller, a second motor controller, a speed control sub-circuit, and a power circuit;

wherein the first motor controller, the second motor controller, the speed control sub-circuit, and the power circuit are electrically interconnected;

wherein the speed control sub-circuit comprises a load resistor and a potentiometer;

wherein the load resistor forms a series electric connection with the potentiometer;

wherein the power circuit comprises a battery, a diode, a charging port, an external power source, and a master switch;

wherein the external power source further comprises a charging plug;

wherein the battery, the diode, the charging port, the external power source, the charging plug, and the master switch are electrically interconnected;

wherein the battery further comprises a first positive terminal and a first negative terminal;

wherein the external power source further comprises a second positive terminal and a second negative terminal.

9. The counter-balancing gyroscopic walker according to claim 8 wherein the u-shaped housing is a hollow structure that contains the plurality of inertial structures and the control circuit.

10. The counter-balancing gyroscopic walker according to claim 9 wherein the first inertial structure comprises a first electric motor, a first flywheel, and a first guide rail system;

wherein the first guide rail system is a means of conveyance for the first precession movement;

wherein the first guide rail system comprises a first plurality of springs, a first plurality of carriages, and a first plurality of guide rails;

wherein the first plurality of springs attaches a first carriage of the first plurality of carriages to the interior surface of the u-shaped housing;

wherein the first flywheel attaches to the first electric motor;

wherein the first electric motor attaches to the first carriage;

wherein the first carriage is conveyed along the first plurality of guide rails;

wherein the first plurality of springs slowly returns the first carriage to a starting point of the first plurality of guide rails;

wherein the first inertial structure stabilizes the counter-balancing gyroscopic walker in a first direction.

11. The counter-balancing gyroscopic walker according to claim 10 wherein the second inertial structure comprises a second electric motor, a second flywheel, and a second guide rail system;

wherein the second guide rail system is a means of conveyance for the second precession movement;

wherein the second guide rail system comprises a second plurality of springs, a second plurality of carriages, and a second plurality of guide rails;

wherein the second plurality of springs attaches a second carriage of the second plurality of carriages to the interior surface of the u-shaped housing;

wherein the second flywheel attaches to the second electric motor;

wherein the second electric motor attaches to the second carriage;

wherein the second carriage is conveyed along the second plurality of guide rails;

wherein the second plurality of springs slowly returns the second carriage to a starting point of the second plurality of guide rails;

wherein the second inertial structure stabilizes the counter-balancing gyroscopic walker in a second direction.

12. The counter-balancing gyroscopic walker according to claim 11 wherein the first electric motor converts electrical energy into angular momentum in the form of a rotation;

wherein the control circuit controls the operation of the first electric motor;

wherein the first electric motor provides a portion of motive forces necessary to generate the angular momentum used to stabilize the housing structure;

wherein the first flywheel is a disk-shaped structure;

wherein the first flywheel is a rotating structure that contains the angular momentum stored by the first inertial structure;

wherein the first flywheel attaches to the first electric motor such that a center axis of the disk-shaped structure of the first flywheel aligns with the axis of rotation of the first electric motor;

wherein the first electric motor provides the motive forces used to: a) initiate the rotation of the first flywheel; and, b) maintain the rotational speed of the first flywheel.

13. The counter-balancing gyroscopic walker according to claim 12 wherein the second electric motor converts electrical energy into angular momentum in the form of a rotation;

wherein the control circuit controls the operation of the second electric motor;

wherein the second electric motor provides a portion of motive forces necessary to generate the angular momentum used to stabilize the housing structure;

wherein the second flywheel is a disk-shaped structure;

wherein the second flywheel is a rotating structure that contains the angular momentum stored by the second inertial structure;

wherein the second flywheel attaches to the second electric motor such that a center axis of the disk-shaped structure of the second flywheel aligns with the axis of rotation of the second electric motor;

wherein the second electric motor provides the motive forces used to: a) initiate the rotation of the second flywheel; and, b) maintain the rotational speed of the second flywheel;

wherein the compound center axis of the second flywheel and the center of rotation of the second electric motor forms a cant with the first flywheel and the center of rotation of the first electric motor.

14. The counter-balancing gyroscopic walker according to claim 13 wherein the first motor controller is an electric circuit that controls the speed of rotation and the direction of rotation of the first electric motor;

wherein the first motor controller monitors a voltage generated by the speed control sub-circuit to determine the speed of rotation of the first electric motor;

wherein the second motor controller is an electric circuit that controls the speed of rotation and the direction of rotation of the second electric motor;

wherein the second motor controller monitors a voltage generated by the speed control sub-circuit to determine the speed of rotation of the second electric motor;

wherein the second motor controller sets the direction of rotation of the second electric motor to the opposite direction of the first electric motor;

wherein the second motor controller monitors the same voltage as is monitored by the first motor controller.

15. The counter-balancing gyroscopic walker according to claim 14 wherein the speed control sub-circuit generates the voltage used by the first motor controller and the second motor controller to determine the speed of rotation of the first electric motor and the second electric motor;

wherein the speed control sub-circuit is a voltage divider circuit that allows for the adjustment of the voltage presented to the first motor controller and the second motor controller;

wherein the resistance presented by the load resistor is fixed;

wherein the load resistor electrically connects to the potentiometer to form a voltage divider;

wherein the potentiometer is an electrical device that presents a variable resistance to an electric circuit;

wherein the voltage across the potentiometer presents the voltage used by the first motor controller to control the speed of rotation of the first electric motor;

wherein the potentiometer presents the voltage used by the second motor controller to control the speed of rotation of the second electric motor;

wherein the voltage presented to the first motor controller and the second motor controller is adjusted by adjusting the resistance presented by the potentiometer to the voltage divider circuit.

16. The counter-balancing gyroscopic walker according to claim 15 wherein the power circuit powers the operation of the control circuit;

wherein the power circuit is an electrochemical device;

wherein the power circuit converts chemical potential energy into the electrical energy required to power the control circuit.

17. The counter-balancing gyroscopic walker according to claim 16 wherein the battery is a rechargeable battery;

wherein the charging port is an electrical circuit that reverses the polarity of the rechargeable;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction.

* * * * *